US007544452B2

(12) United States Patent
Wu et al.

(10) Patent No.: US 7,544,452 B2
(45) Date of Patent: Jun. 9, 2009

(54) THICK UNDERCOATS

(75) Inventors: Jin Wu, Webster, NY (US); Daniel V. Levy, Rochester, NY (US); Liang-bih Lin, Rochester, NY (US); James R. Backus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 329 days.

(21) Appl. No.: 11/211,757

(22) Filed: Aug. 26, 2005

(65) Prior Publication Data

US 2007/0049677 A1 Mar. 1, 2007

(51) Int. Cl.
*G03G 5/14* (2006.01)

(52) U.S. Cl. ..... 430/60; 524/430; 524/431; 430/64; 430/65; 399/159

(58) Field of Classification Search ..... 430/60, 430/64, 65; 524/430, 431; 399/159
See application file for complete search history.

(56) References Cited

U.S. PATENT DOCUMENTS 3,871,896 A * 3/1975 Matsudaira et al. ..... 428/416
4,265,990 A 5/1981 Stolka et al.
4,921,769 A 5/1990 Yuh et al.
5,595,847 A * 1/1997 Nogami et al. ..... 430/64
5,725,985 A 3/1998 Nealey et al.
5,958,638 A 9/1999 Katayama et al.
6,017,666 A 1/2000 Nealey et al.
6,132,912 A 10/2000 Fuller et al.
6,156,468 A 12/2000 Wehelie et al.
6,177,219 B1 1/2001 Yuh et al.
6,255,027 B1 7/2001 Wehelie et al.
6,287,737 B1 9/2001 Ong et al.
6,444,386 B1 9/2002 Liu et al.
6,970,675 B1 * 11/2005 Yoshino et al. ..... 399/307
2002/0160680 A1 * 10/2002 Laurence et al. ..... 442/394
2003/0185599 A1 * 10/2003 Enoki et al. ..... 399/267
2004/0179861 A1 * 9/2004 Mochizuki et al. ..... 399/159
2004/0183885 A1 * 9/2004 Hoshizaki et al. ..... 347/129
2004/0202947 A1 * 10/2004 Wu et al. ..... 430/59.4

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

Binders containing metal oxide nanoparticles and a co-resin of phenolic resin and aminoplast resin, and electrophotographic imaging member undercoat layer containing the binders.

18 Claims, 1 Drawing Sheet

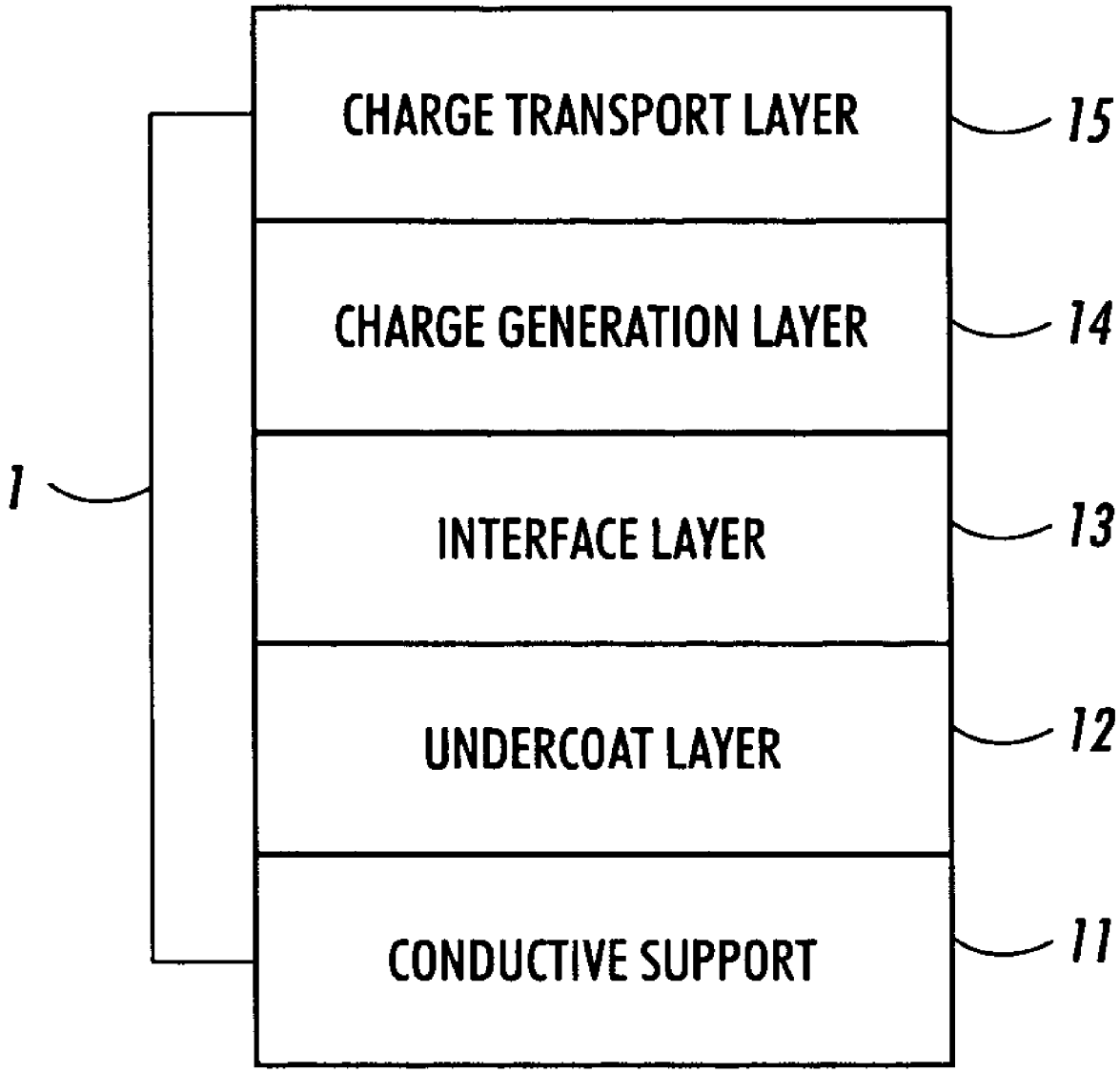
CHARGE TRANSPORT LAYER
15
CHARGE GENERATION LAYER
14
1
INTERFACE LAYER
13
UNDERCOAT LAYER
12
CONDUCTIVE SUPPORT
11

THICK UNDERCOATS

TECHNICAL FIELD

This disclosure is generally directed to binders containing metal oxide nanoparticles, and electrographic imaging members containing the binders. More particularly, this disclosure is generally directed to binders containing metal oxide nanoparticles and a co-resin of phenolic resin and aminoplast resin, and electrographic imaging members containing the binders.

BACKGROUND

In xerography, or electrophotographic printing/copying, an electrophotographic imaging member is electrostatically charged. For optimal image production, the electrophotographic imaging member should be uniformly charged across its entire surface. The electrophotographic imaging member is then exposed to a light pattern of an input image to selectively discharge the surface of the electrophotographic imaging member in accordance with the image. The resulting pattern of charged and discharged areas on the electrophotographic imaging member forms an electrostatic charge pattern (i.e., a latent image) conforming to the input image. The latent image is developed by contacting it with finely divided electrostatically-attractable powder called toner. Toner is held on the image areas by electrostatic force. The toner image may then be transferred to a substrate or support member, and the image is then affixed to the substrate or support member by a fusing process to form a permanent image on the substrate or support member. After transfer, excess toner left on the electrophotographic imaging member is cleaned from its surface, and residual charge is erased from the electrophotographic imaging member.

Electrophotographic imaging members can be provided in a number of forms. For example, an electrophotographic imaging member can be a homogeneous layer of a single material, such as vitreous selenium, or it can be a composite layer containing an electrophotographic layer and another material. In addition, the electrophotographic imaging member can be layered.

Conventional layered electrophotographic imaging members generally have at least a flexible substrate support layer and two active layers. These active layers generally include a charge generation layer containing a light absorbing material, and a charge transport layer containing charge transport molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

Conventional electrophotographic imaging members may be either a function-separation type photoreceptor, in which a layer containing a charge generation substance (charge generation layer) and a layer containing a charge transport substance (charge transport layer) are separately provided, or a monolayer type photoreceptor in which both the charge generation layer and the charge transport layer are contained in the same layer.

Conventional binders used in electrophotographic imaging members typically contain vinyl chloride. Examples of conventional binders are disclosed in U.S. Pat. No. 5,725,985, incorporated herein by reference in its entirety, and U.S. Pat. No. 6,017,666, incorporated herein by reference in its entirety. Additionally, electrophotographic imaging members may be non-halogenated polymeric binders, such as a non-halogenated copolymers of vinyl acetate and vinyl acid.

Conventional electrophotographic imaging members may have an undercoat layer interposed between the conductive support and the charge generation layer. Examples of conventional undercoat layers are disclosed in U.S. Pat. Nos. 4,265,990; 4,921,769; 5,958,638; 5,958,638; 6,132,912; 6,287,737; and 6,444,386; incorporated herein by reference in their entireties.

SUMMARY

Thick undercoat layers are desirable for electrophotographic imaging members because thick undercoat layers have longer life spans, are resistant to carbon fiber, and permit the use of cheaper substrates. However, due to insufficient electron conductivity in dry and cold environments, the residual potential ($V_r$) in C zone (10% humidity and 15° C.) is unacceptably high (>150V) when the undercoat is thicker than about 15 μm. Thus, there is a need for novel undercoat layers that improve the electrical properties and performance of electrophotographic imaging members. The disclosure describes novel binders that improve the electrical properties and performance of thick undercoat layers and electrophotographic imaging members containing thick undercoat layers.

As used herein, an aminoplast resin refers to a type of amino resin made from nitrogen-containing substance and formaldehyde, wherein the nitrogen-containing substance includes melamine, urea, benzoguanamine and glycoluril. Also as used herein, a phenolic resin refers to a resin made from phenols or substituted phenols with aldehydes.

In embodiments, an electrographic, such as electrostatographic or electrophotographic, imaging member binder contains metal oxide nanoparticles and a co-resin comprising a phenolic resin and an aminoplast resin. In various embodiments, the phenolic resin is a phenolic-formaldehyde resin. In various embodiments, the aminoplast resin is a melamine-formaldehyde resin, a urea-formaldehyde resin, a benzoguanamine-formaldehyde resin, a glycoluril-formaldehyde resin, and/or mixtures thereof. In various embodiments, a ratio of the phenolic resin to the aminoplast resin in the co-resin can be from about 1/99 to about 99/1.

In embodiments, the metal oxide nanoparticles can be selected from, for example, the group consisting of ZnO, $SnO_2$, $TiO_2$, $Al_2O_3$, $SiO_2$, $ZrO_2$, $In_2O_3$, $MoO_3$, and a complex oxide thereof. In various embodiments, the metal oxide nanoparticles can be $TiO_2$. In various embodiments, the metal oxide nanoparticles can have a powder volume resistivity varying from about $10^4$ to about $10^{10}$ Ωcm at a 100 kg/cm$^2$ loading pressure, 50% humidity, and room temperature. In various embodiments, a ratio of the metal oxide nanoparticles to the co-resin can be about 20/80 to about 80/20 wt/wt.

In embodiments, an electrophotographic imaging member binder contains metal oxide nanoparticles, a co-resin comprising a phenolic resin and an aminoplast resin, an optional acid catalyst and an optional light scattering particle. In various embodiments, the acid catalyst can be para-toluene sulfonic acid, an amine salt of para-toluene sulfonic acid, an phosphate ester, an amine salt of phenyl acid phosphate, or an amine salt of dinonylnaphthalenedisulfonic acid. In various embodiments, the acid catalyst can be present in an amount of about 0% to about 1.0% by weight of a total weight of the electrophotographic imaging member binder.

In various embodiments, the light scattering particle has a refractive index different from the binder and has a number average particle size greater than about 0.8 μm. The light scattering particle can be amorphous silica, silicone ball. In various embodiments, the light scattering particle can be present in an amount of about 0% to about 10% by weight of a total weight of the electrophotographic imaging member binder.

In embodiments, an electrophotographic imaging member undercoat layer contains metal oxide nanoparticles and a co-resin comprising a phenolic resin and an aminoplast resin. In various embodiments, the phenolic resin can be a phenolic-formaldehyde resin. In various embodiments, the aminoplast resin is a melamine-formaldehyde resin, a urea-formaldehyde resin, a benzoguanamine-formaldehyde resin, a glycoluril-formaldehyde resin, and/or mixtures thereof. In various embodiments, a ratio of the phenolic resin to the aminoplast resin in the co-resin can be about 1/99 to about 99/1.

In various embodiments, the metal oxide nanoparticles of the undercoat layer can be selected from ZnO, $SnO_2$, $TiO_2$, $Al_2O_3$, $SiO_2$, $ZrO_2$, $In_2O_3$, $MoO_3$, and a complex oxide thereof. In various embodiments, the metal oxide nanoparticles can be $TiO_2$. In various embodiments, the metal oxide nanoparticles can have a powder volume resistivity varying from about $10^4$ to about $10^{10}$ Ωcm at 100 kg/cm$^2$ pressure, 50% humidity, and room temperature. In various embodiments, a ratio of the metal oxide nanoparticles to the co-resin can be about 20/80 to about 80/20 wt/wt.

In various embodiments, the undercoat layer optionally further contains an acid catalyst. In various embodiments, the acid catalyst can be para-toluene sulfonic acid, an amine salt of para-toluene sulfonic acid, a phosphate ester, an amine salt of phenyl acid phosphate, or an amine salt of dinonylnaphthalenedisulfonic acid. In various embodiments, the acid catalyst can be present in an amount of about 0% to about 1.0% by weight of a total weight of the electrophotographic imaging member binder.

In various embodiments, the undercoat layer further contains an optional light scattering particle. In various embodiments, the light scattering particle has a refractive index different from the binder and has a number average particle size greater than about 0.8 μm. The light scattering particle can be amorphous silica, silicone ball. In various embodiments, the light scattering particle can be present in an amount of about 0% to about 10% by weight of a total weight of the electrophotographic imaging member binder.

In embodiments, an electrophotographic imaging member contains a support layer, a charge generation layer, a charge transport layer, an undercoat layer, and a binder containing metal oxide nanoparticles and a co-resin comprising a phenolic resin and an aminoplast resin. In various embodiments, the undercoat layer contains metal oxide nanoparticles and a co-resin comprising a phenolic resin and an aminoplast resin.

In embodiments, an electrophotographic process cartridge contains an electrophotographic imaging member containing metal oxide nanoparticles and a co-resin comprising a phenolic resin and an aminoplast resin, and contains at least one of a developing unit and a cleaning unit. In various embodiments, the electrophotographic imaging member contains an under coat layer containing metal oxide nanoparticles and a co-resin comprising a phenolic resin and an aminoplast resin. In various embodiments, the undercoat layer has a thickness of from about 0.1 μm to about 30 μm, or from about 2 μm to about 25 μm, or from about 10 μm to about 20 μm.

In embodiments, an electrophotographic image forming apparatus contains an electrophotographic imaging member containing metal oxide nanoparticles and a co-resin comprising a phenolic resin and an aminoplast resin, and contains at least one charging unit, at least one exposing unit, at least one developing unit, a transfer unit, and a cleaning unit. In various embodiments, the electrophotographic imaging member contains an under coat layer containing metal oxide nanoparticles and a co-resin comprising a phenolic resin and an aminoplast resin. In various embodiments, the undercoat layer has a thickness of from about 0.1 μm to about 30 μm, or from about 2 μm to about 25 μm, or from about 10 μm to about 20 μm.

BRIEF DESCRIPTION OF THE DRAWINGS

The FIGURE is a block diagram outlining the elements of an electrophotographic imaging member.

DETAILED DESCRIPTION OF PREFERRED EMBODIMENTS

In embodiments, an electrophotographic imaging member binder contains metal oxide nanoparticles and a co-resin comprising a phenolic resin and an aminoplast resin.

As used herein, phenolic resins are condensation products of an aldehyde with a phenol source in the presence of an acidic or basic catalyst.

In embodiments, the phenol source may be, for example, phenol, alkyl-substituted phenols such as cresols and xylenols, halogen-substituted phenols such as chlorophenol, polyhydric phenols such as resorcinol or pyrocatechol, polycyclic phenols such as naphthol and bisphenol A, aryl-substituted phenols, cyclo-alkyl-substituted phenols, aryloxy-substituted phenols, and combinations thereof. In various embodiments, the phenol source may be phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols such as bisphenol A, and combinations thereof.

In embodiments, the aldehyde may be, for example, formaldehyde, paraformaldehyde, acetaldehyde, butyraldehyde, paraldehyde, glyoxal, furfuraldehyde, propinonaldehyde, benzaldehyde, and combinations thereof. In various embodiments, the aldehyde is formaldehyde.

In embodiments, the phenolic resin may be, for example, selected from dicyclopentadiene type phenolic resins, phenol novolak resins, cresol novolak resins, phenol aralkyl resins, and combinations thereof. U.S. Pat. Nos. 6,255,027, 6,177,219, and 6,156,468, incorporated herein by reference in their entireties, disclose examples of photoreceptors containing a hole blocking layer of a plurality of light scattering particles dispersed in a binder. For example, see Example I of U.S. Pat. No. 6,156,468, which discloses a hole blocking layer of titanium dioxide dispersed in a specific linear phenolic binder of VARCUM™ (available from OxyChem Company). Examples of phenolic resins include, but are not limited to, formaldehyde polymers with phenol, p-tert-butylphenol, and cresol, such as VARCUM™ 29159 and 29101 (OxyChem Co.) and DURITE™ 97 (Borden Chemical), or formaldehyde polymers with ammonia, cresol, and phenol, such as VARCUM™ 29112 (OxyChem Co.), or formaldehyde polymers with 4,4'-(1-methylethylidene) bisphenol such as VARCUM™ 29108 and 29116 (OxyChem Co.), or formaldehyde polymers with cresol and phenol such as VARCUM™ 29457 (OxyChem Co.), DURITE™ SD-423A, SD-422A (Borden Chemical), or formaldehyde polymers with phenol and p-tert-butylphenol such as DURITE™ ESD 556C (Border Chemical).

In embodiments, the phenolic resins can be used as-is, or they can be modified to enhance certain properties. For example, the phenolic resins can be modified with suitable plasticizers, e.g. including but not limited to polyvinyl butyral, polyvinyl formal, alkyds, epoxy resins, phenoxy resins (bisphenol A, epichlorohydrin polymer) polyamides, oils, and the like.

As used herein, aminoplast resin refers to a type of amino resin made from nitrogen-containing substance and formaldehyde, wherein the nitrogen-containing substance includes melamine, urea, benzoguanamine and glycoluril. Also as used herein, melamine resins are amino resins made from melamine and formaldehyde. Melamine resins are known under various trade names, including but not limited to CYMEL™, BEETLE™, DYNOMIN™, BECKAMINE™, UFR™, BAKELITE™, ISOMIN™, MELAICAR™, MELBRITE™, MELMEX™, MELOPAS™, RESART™, and ULTRAPAS™. As used herein, urea resins are amino resins made from urea and formaldehyde. Urea resins are known under various trade names, including but not limited to CYMEL™, BEETLE™, UFRM™, DYNOMIN™, BECKAMINE™, and AMIREME™. As used herein, benzoguanamine resins are amino resins made from benzoguanamine and formaldehyde. Benzoguanamine resins are known under various trade names, including but not limited to CYMEL™, BEETLE™, and UFORMITE™. As used herein, glycoluril resins are amino resins made from glycoluril and formaldehyde. Glycoluril resins are known under various trade names, including but riot limited to CYMEL™, and POWDERLINK™. The aminoplast resins can be highly alkylated or partially alkylated.

In embodiments, the melamine resin has a generic formula of

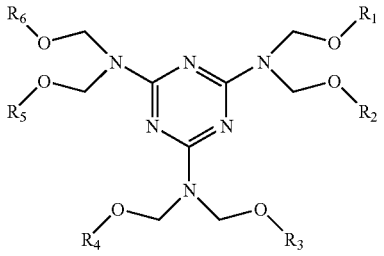

in which $R_1$, $R_2$, $R_3$, $R_4$, $R_5$ and $R_6$ each independently represents a hydrogen atom or an alkyl chain with 1 to 8 carbon atoms, or with 1 to 4 carbon atoms.

In embodiments, the melamine resin is water-soluble, dispersible or indispersible. In various embodiments, the melamine resin can be highly alkylated/alkoxylated, partially alkylated/alkoxylated, or mixed alkylated/alkoxylated. In various embodiments, the melamine resin can be methylated, n-butylated or isobutylated. Examples of the melamine resin include highly methylated melamine resins such as CYME™L 350, 9370; methylated high imino melamine resins (partially methylolated and highly alkylated) such as CYMEL™ 323, 327; partially methylated melamine resins (highly methylolated and partially methylated) such as CYMEL™ 373, 370; high solids mixed ether melamine resins such as CYMEL™ 1130, 324; n-butylated melamine resins such as CYMEL™ 1151, 615; n-butylated high imino melamine resins such as CYMEL™ 1158; iso-butylated melamine resins such as CYMEL™ 255-10. CYMEL™ melamine resins are commercially available from CYTEC.

In embodiments, the melamine resin may be selected from methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

In embodiments, the urea resin has a generic formula of

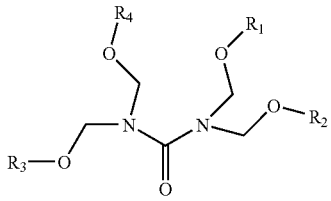

in which $R_1$, $R_2$, $R_3$, and $R_4$ each independently represents a hydrogen atom or an alkyl chain with 1 to 8 carbon atoms, or with 1 to 4 carbon atoms.

In embodiments, the urea resin is water-soluble, dispersible or indispersible. In various embodiments, the urea resin can be highly alkylated/alkoxylated, partially alkylated/alkoxylated, or mixed alkylated/alkoxylated. In various embodiments, the urea resin can be methylated, n-butylated or isobutylated. Examples of the urea resin include methylated urea resins such as CYMEL™ U-65, U-382; n-butylated urea resins such as CYMEL™ U-1054, UB-30-B; isobutylated urea resins such as CYMEL™ U-662, UI-19-I. CYMEL™ urea resins are commercially available from CYTEC.

In embodiments, the benzoguanamine resin has a generic formula of

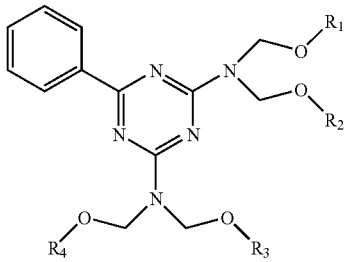

in which $R_1$, $R_2$, $R_3$, and $R_4$ each independently represents a hydrogen atom or an alkyl chain with 1 to 8 carbon atoms, or with 1 to 4 carbon atoms.

In embodiments, the benzoguanamine resin is water-soluble, dispersible or indispersible. In various embodiments, the benzoguanamine resin can be highly alkylated/alkoxylated, partially alkylated/alkoxylated, or mixed alkylated/alkoxylated. In various embodiments, the benzoguanamine resin can be methylated, n-butylated or isobutylated. Examples of the benzoguanamine resin include CYMEL™ 659, 5010, 5011. CYMEL™ benzoguanamine resins are commercially available from CYTEC.

In embodiments, the glycoluril resin has a generic formula of

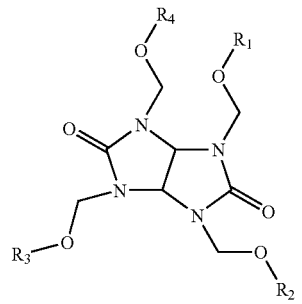

in which $R_1$, $R_2$, $R_3$, and $R_4$ each independently represents a hydrogen atom or an alkyl chain with 1 to 8 carbon atoms, or with 1 to 4 carbon atoms.

In embodiments, the glycoluril resin is water-soluble, dispersible or indispersible. In various embodiments, the glycoluril resin can be highly alkylated/alkoxylated, partially alkylated/alkoxylated, or mixed alkylated/alkoxylated. In various embodiments, the glycoluril resin can be methylated, n-butylated or isobutylated. Examples of the glycoluril resin include CYMEL™ 1170, 1171. CYMEL™ glycoluril resins are commercially available from CYTEC.

In embodiments, a ratio of the phenolic resin to the aminoplast resin in the co-resin can be about 1/99 to about 99/1. In various embodiments, the ratio of the phenolic resin to the aminoplast resin in the co-resin can be about 20/80 to about 80/20. In various embodiments, the ratio of the phenolic resin to the aminoplast resin in the co-resin can be about 30/70 to about 70/30.

In embodiments, the metal oxide nanoparticles may be selected from, for example, ZnO, $SnO_2$, $TiO_2$, $Al_2O_3$, $SiO_2$, $ZrO_2$, $In_2O_3$, $MoO_3$, and a complex oxide thereof. In various embodiments, the metal oxide nanoparticles have a powder volume resistivity varying from about $10^4$ to about $10^{10}$ Ωcm at a 100 kg/cm$^2$ loading pressure, 50% humidity, and room temperature. In various embodiments, the metal oxide nanoparticles are $TiO_2$. Examples of $TiO_2$ nanoparticles include STR-60N (no surface treatment and powder volume resisitivity of approximately $9\times10^5$ Ωcm) (available from Sakai Chemical Industry Co., Ltd.), FTL-100 (no surface treatment and powder volume resisitivity of approximately $3\times10^5$ Ωcm) (available from Ishihara Sangyo Laisha, Ltd.), STR-60 ($Al_2O_3$ coated and powder volume resisitivity of approximately $4\times10^6$ Ωcm) (available from Sakai Chemical Industry Co., Ltd.), TTO-55N (no surface treatment and powder volume resisitivity of approximately $5\times10^5$ Ωcm) (available from Ishihara Sangyo Laisha, Ltd.), TTO-55A ($Al_2O_3$ coated and powder volume resisitivity of approximately $4\times10^7$ Ωcm) (available from Ishihara Sangyo Laisha, Ltd.), MT-150W (sodium metaphosphated coated and powder volume resisitivity of approximately $4\times10^4$ Ωcm) (available from Tayca), and MT-150AW (no surface treatment and powder volume resisitivity of approximately $1\times10^5$ Ωcm) (available from Tayca). In various embodiments, a ratio of the metal oxide nanoparticles to the co-resin can be from about 20/80 to about 80/20 wt/wt, or from about 40/60 to about 65/35.

In embodiments, the electrophotographic imaging member binder may optionally contain an acid catalyst. In various embodiments, the acid catalyst can be a para-toluene sulfonic acid. In various embodiments, the acid catalyst is CYCAT™ 4040 commercially available from CYTEC. In various embodiments, the acid catalyst is an amine neutralized para-toluene sulfonic acid. In various embodiments, the acid catalyst is NACURE™ 2107 commercially available from King Industries. In various embodiments, the acid catalyst is an amine neutralized phenyl acid phosphate. In various embodiments, the acid catalyst is NACURE™ 4575 commercially available from King Industries. In various embodiments, the acid catalyst is an amine neutralized dinonylnaphthalenedisulfonic acid. In various embodiments, the acid catalyst is NACURE™ 3525 commercially available from King Industries. In various embodiments, the acid catalyst is used to cure the phenolic/aminoplast co-resin. In various embodiments, the phenolic/aminoplase co-resin is cured at temperatures from about 120° C. to about 195° C., or from about 145° C. to about 160° C. for a period of from about 10 minutes to about 60 minutes, or from about 20 minutes to about 45 minutes. In various embodiments, the phenolic/aminoplast co-resin is cured at 160° C. for 15 minutes. In embodiments, the acid catalyst can be present in an amount of from about 0% to about 1.0%, or from about 0.1% to about 0.4% by weight of a total weight of the electrophotographic imaging member binder.

In various embodiments, the electrophotographic imaging member binder may optionally contain a light scattering particle. In various embodiments, the light scattering particle has a refractive index different from the binder and has a number average particle size greater than about 0.8 μm. Examples of the light scattering particle include, but are not limited to, inorganic materials such as amorphous silica, silicone ball and minerals. Typical minerals include, for example, metal oxides, silicates, carbonates, sulfates, iodites, hydroxides, chlorides, fluorides, phosphates, chromates, clay, sulfur and the like. In various embodiments, the light scattering particle is amorphous silica P-100, commercially available from Espirit Chemical Co. In various embodiments, the light scattering particle can be present in an amount of from about 0% to about 10%, or from about 2% to about 5% by weight of a total weight of the electrophotographic imaging member binder.

Electrophotographic Imaging Member

The FIGURE is a cross sectional view schematically showing an embodiment of an electrophotographic imaging member. The electrophotographic imaging member 1 shown in the FIGURE contains separate charge generation layer 14 and charge transport layer 15. In the embodiment illustrated in the FIGURE, an undercoat layer 12 and an optional interface layer 13 are included in the electrophotographic imaging member 1. In embodiments, the undercoat layer 12 is interposed between the charge generation layer 14 and the conductive support 11. In embodiments, the interface layer is interposed between the undercoat layer 12 and the charge generation layer 14. In embodiments, the undercoat layer is located between the conductive support and the charge generation layer, without any intervening layers. In various embodiments, additional layers, such as an interface layer or an adhesive layer, may be present and located between the undercoat layer and the charge generation layer, and/or between the conductive support and the undercoat layer.

In embodiments, the conductive support 11 may include, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

In embodiments, the undercoat layer 12 contains metal oxide nanoparticles and a co-resin comprising a phenolic resin and a melamine resin. In various embodiments, the phenolic resin is VARCUM™ 29159, commercially available from OxyChem. In various embodiments, the melamine resin is selected from CYMEL™ 350, 9370, 323, 327, U-65, and 1171, commercially available from CYTEC. In various embodiments, the melamine resin is CYMEL™ 323. In embodiments, a ratio of the phenolic resin to the melamine resin in the binder is about 1/99 to about 99/1. In various embodiments, the metal oxide nanoparticles are $TiO_2$. For example, in various embodiments, the $TiO_2$ is MT-150W, commercially available from Tayca. In various embodiments, the metal oxide nanoparticles have a powder volume resistivity varying from about $10^4$ to about $10^{10}$ Ωcm at a 100 kg/cm$^2$ loading pressure, 50% humidity, and room temperature. In various embodiments, a ratio of the metal oxide nanoparticles to the co-resin is about 20/80 to about 80/20 wt/wt.

In embodiments, the undercoat layer 12 may also contain one or more conventional binders. Examples of conventional binders include, but are not limited to, polyamides, vinyl chlorides, vinyl acetates, phenols, polyurethanes, melamines, benzoguanamines, polyimides, polyethylenes, polypropylenes, polycarbonates, polystyrenes, acrylics, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and combinations thereof.

In embodiments, the undercoat layer 12 may optionally contain an acid catalyst. In various embodiments, the acid catalyst is a para-toluene sulfonic acid. In various embodiments, the acid catalyst is CYCAT™ 4040 commercially available from CYTEC. In embodiments, the acid catalyst is present in an amount of about 0% to about 1.0% by weight of a total weight of the electrophotographic imaging member binder.

In embodiments, the undercoat layer 12 may contain an optional light scattering particle. In various embodiments, the light scattering particle has a refractive index different from the binder and has a number average particle size greater than about 0.8 μm. In various embodiments, the light scattering particle is amorphous silica P-100 commercially available from Espirit Chemical Co. In various embodiments, the light scattering particle is present in an amount of about 0% to about 10% by weight of a total weight of the electrophotographic imaging member binder.

In embodiments, the undercoat layer 12 may contain various colorants. In various embodiments, the undercoat layer may contain organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer 12 may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and combinations thereof.

In embodiments, the undercoat layer 12 may be formed between the electroconductive support and the charge generation layer. The undercoat layer is effective for blocking leakage of charge from the electroconductive support to the charge generation layer and/or for improving the adhesion between the electroconductive support and the charge generation layer. In embodiments, one or more additional layers may exist between the undercoat layer 12 and the charge generation layer.

In embodiments, the undercoat layer 12 can be coated onto the conductive support 11 from a suitable solvent. Suitable solvents include, but are not limited to, xylene/1-butanol/MEK, N,N-dimethyl formamide, N,N-dimethyl acetamide, dimethyl sulfoxide, tetrahydrofuran, dichloromethane, xylene, toluene, methanol, ethanol, 1-butanol, isobutanol, methyl ethyl ketone, methyl isobutyl ketone, and mixtures thereof.

In embodiments, the undercoat layer 12 may be coated onto the conductive substrate 11 using various coating methods. Suitable coating methods include, but are not limited to, blade coating, wire bar coating, spray coating, dip coating, bead coating, air knife coating or curtain coating is employed.

In embodiments, the thickness of the undercoat layer 12 is from about 0.1 μm to 30 μm, or from about 2 μm to 25 μm, or from about 10 μm to 20 μm. In embodiments, electrophotographic imaging members contain undercoat layers having a thickness of from about 0.1 μm to 30 μm, or from about 2 μm to 25 μm, or from about 10 μm to 20 μm.

In embodiments, the electrophotographic imaging member 1 may optionally include an interface layer 13. In various embodiments, the interface layer 13 may contain one or more conventional components. Examples of conventional components include, but are not limited to, polyesters, polyamides, poly(vinyl butyral), poly(vinyl alcohol), polyurethane and polyacrylonitrile. In various embodiments, the interface layer may also contain conductive and nonconductive particles, such as zinc oxide, titanium dioxide, silicon nitride, carbon black, and the like.

In embodiments, the interface layer 13 may be coated onto a substrate using various coating methods. Suitable coating methods include, but are not limited to, blade coating, wire bar coating, spray coating, dip coating, bead coating, air knife coating or curtain coating is employed. In embodiments, the thickness of the interface layer is from about 0.001 μm to about 5 μm. In various embodiments, the thickness of the interface layer is less than about 1.0 μm. In various embodiments, the thickness of the interface layer is about 0.5 μm.

In embodiments, the charge generation layer 14 can be formed by applying a coating solution containing the charge generation substance(s) and a binding resin, and further fine particles, an additive, and other components.

In embodiments, binding resins used in the charge generation layer 14 may include polyvinyl acetal resins, polyvinyl formal resins or a partially acetalized polyvinyl acetal resins in which butyral is partially modified with formal or acetoacetal, polyamide resins, polyester resins, modified ether-type polyester resins, polycarbonate resins, acrylic resins, polyvinyl chloride resins, polyvinylidene chlorides, polystyrene resins, polyvinyl acetate resins, vinyl chloride-vinyl acetate copolymers, silicone resins, phenol resins, phenoxy resins, melamine resins, benzoguanamine resins, urea resins, polyurethane resins, poly-N-vinylcarbazole resins, polyvinylanthracene resins and polyvinylpyrene resins. These can be used either alone or as a combination of two or more of them.

In embodiments, the solvents used in preparing the charge generation layer coating solution may include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform, mixtures of two or more of thereof, and the like.

In embodiments, the charge generation layer 14 may include various charge generation substances, including, but not limited to, various organic pigments and organic dyes such as an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide. The charge generation substances may be used either alone or as a combination of two or more of them. In embodiments, the ratio of the charge generation substance to the binding resin is within the range of 5:1 to 1:2 by volume.

In embodiments, the charge generation layer 14 is formed by various forming methods, including but not limited to, dip coating, roll coating, spray coating, rotary atomizers, and the like. In various embodiments, the charge generation layer 14 is formed by the vacuum deposition of the charge generation substance(s), or by the application of a coating solution in which the charge generation substance is dispersed in an organic solvent containing a binding resin. In embodiments, the deposited coating may be effected by various drying methods, including, but not limited to, oven drying, infra-red radiation drying, air drying and the like.

In embodiments, a stabilizer such as an antioxidant or an inactivating agent can be added to the charge generation layer 14. The antioxidants include, for example, antioxidants such as phenolic, sulfur, phosphorus and amine compounds. The inactivating agents include bis(dithiobenzyl)nickel and nickel di-n-butylthiocarbamate. The charge transport layer 14 may further contain an additive such as a plasticizer, a surface modifier, and an agent for preventing deterioration by light.

In embodiments, the charge transport layer 15 can be formed by applying a coating solution containing the charge transport substance(s) and a binding resin, and further fine particles, an additive, and other components.

In embodiments, binding resins used in the charge transport layer 15 are high molecular weight polymers that can form an electrical insulating film. Examples of these binding resins include, but are not limited to, polyvinyl acetal resins, polyamide resins, cellulose resins, phenol resins, polycarbonates, polyesters, methacrylic resins, acrylic resins, polyvinyl chlorides, polyvinylidene chlorides, polystyrenes, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinylcarbazoles, polyvinyl butyrals, polyvinyl formals, polysulfones, caseins, gelatins, polyvinyl alcohols, phenol resins, polyamides, carboxymethyl celluloses, vinylidene chloride-based polymer latexes, and polyurethanes.

In embodiments, the charge transport layer 15 may include various activating compounds that, as an additive dispersed in electrically inactive polymeric materials, makes these materials electrically active. These compounds may be added to polymeric materials which are incapable of supporting the injection of photogenerated holes from the charge generation material and incapable of allowing the transport of these holes therethrough. This will convert the electrically inactive polymeric material to a material capable of supporting the injection of photogenerated holes from the charge generation material and capable of allowing the transport of these holes through the active layer in order to discharge the surface charge on the active layer. In embodiments, the charge transport layer 15 is from about 25 percent to about 75 percent by weight of at least one charge transporting aromatic amine compound, and about 75 percent to about 25 percent by weight of a polymeric film forming resin in which the aromatic amine is soluble.

In embodiments, low molecular weight charge transport substances may include, but are not limited to, pyrenes, carbazoles, hydrazones, oxazoles, oxadiazoles, pyrazolines, arylamines, arylmethanes, benzidines, thiazoles, stilbenes, and butadiene compounds. Further, high molecular weight charge transport substances may include, but are not limited to, poly-N-vinylcarbazoles, poly-N-vinylcarbazole halides, polyvinyl pyrenes, polyvinylanthracenes, polyvinylacridines, pyrene-formaldehyde resins, ethylcarbazole-formaldehyde resins, triphenylmethane polymers, and polysilanes.

In embodiments, the charge transport layer 15 may contain an additive such as a plasticizer, a surface modifier, an antioxidant or an agent for preventing deterioration by light.

In embodiments, the charge transport layer 15 may be mixed and applied to a coated or uncoated substrate by various methods, including, but not limited to, spraying, dip coating, roll coating, wire wound rod coating, and the like. In embodiments, the charge transport layer 15 may be dried by various drying method, including, but not limited to, oven drying, infra-red radiation drying, air drying and the like.

In embodiments, an overcoat layer may be applied to improve resistance to abrasion. The overcoat layer may contain a resin, a silicon compound and metal oxide nanoparticles. The overcoat layer may further contain a lubricant or fine particles of a silicone oil or a fluorine material, which can also improve lubricity and strength. In embodiments, the thickness of the overcoat layer is from 0.1 to 10 μm, from 0.5 to 7 μm, or from 1.5 to 3.5 μm.

In embodiments, an anti-curl back coating may be applied to provide flatness and/or abrasion resistance where a web configuration photoreceptor is fabricated. An example of an anti-curl backing layer is described in U.S. Pat. No. 4,654,284, incorporated herein by reference in its entirety.

Image Forming Apparatus and Process Cartridge

In embodiments, an image forming apparatus contains a non-contact charging unit (e.g., a corotron charger) or a contact charging unit, an exposure unit, a developing unit, a transfer unit and a cleaning unit are arranged along the rotational direction of an electrophotographic imaging member. In embodiments, the image forming apparatus is equipped with an image fixing device, and a medium to which a toner image is to be transferred is conveyed to the image fixing device through the transfer device.

In embodiments, the contact charging unit has a roller-shaped contact charging member. The contact charging unit is arranged so that it comes into contact with a surface of the electrophotographic imaging member, and a voltage is applied, thereby being able to give a specified potential to the surface of the electrophotographic imaging member. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

In embodiments, a covering layer can also be provided on a surface of the contact charging unit. Materials for forming this covering layer may include N-alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

In embodiments, the resistance of the contact charging unit is from $10^0$ to $10^{14}$ Ωcm, or from $10^2$ to $10^{12}$ Ωcm. When a voltage is applied to this contact charging unit, either a DC voltage or an AC voltage can be used as the applied voltage. Further, a superimposed voltage of a DC voltage and an AC voltage can also be used. Such a contact charging unit may be in the shape of a blade, a belt, a brush or the like.

In embodiments, the exposure unit can be an optical device which can perform desired image wise exposure to a surface of the electrophotographic imaging member with a light source such as a semiconductor laser, an LED (light emitting diode) or a liquid crystal shutter. In various embodiments, the use of the exposure unit makes it possible to perform exposure to noninterference light.

In embodiments, the developing unit can be a known or later used developing unit using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

In embodiments, the transfer unit can be a contact type transfer charging device using a belt, a roller, a film, a rubber blade or the like, or a scorotron transfer charger or a corotron transfer charger utilizing corona discharge.

In embodiments, the cleaning unit can be a device for removing a remaining toner adhered to the surface of the electrophotographic imaging member after a transfer step, and the cleaned electrophotographic imaging member is repeatedly subjected to the above-mentioned image formation process. The cleaning unit can be a cleaning blade, a cleaning brush, a cleaning roll or the like. In embodiments, a cleaning blade is used. Materials for the cleaning blade may include urethane rubber, neoprene rubber and silicone rubber.

In embodiments, an intermediate transfer belt is supported with a driving roll, a backup roll and a tension roll at a specified tension, and rotatable by the rotation of these rolls without the occurrence of deflection. Further, a secondary transfer roll can be arranged so that it is brought into abutting contact with the backup roll through the intermediate transfer belt. The intermediate transfer belt which has passed between the backup roll and the secondary transfer roll can be cleaned up by a cleaning blade, and then repeatedly subjected to the subsequent image formation process.

The disclosure should not be construed as being limited to the above-mentioned embodiments. For example, in embodiments, the image forming apparatus can be equipped with a process cartridge comprising the electrophotographic imaging member(s) and charging device(s). The use of such a process cartridge allows maintenance to be performed more simply and easily.

Furthermore, in embodiments, a toner image formed on the surface of the electrophotographic imaging member can be directly transferred to the medium. In various other embodiments, the image forming apparatus may be provided with an intermediate transfer body. This makes it possible to transfer the toner image from the intermediate transfer body to the medium after the toner image on the surface of the electrophotographic imaging member has been transferred to the intermediate transfer body. In embodiments, the intermediate transfer body can have a structure in which an elastic layer containing a rubber, an elastomer, a resin or the like and at least one covering layer are laminated on a conductive support.

In addition, in embodiments, the disclosed image forming apparatus may be further equipped with a static eliminator such as an erase light irradiation device. This prevents the incorporation of the residual potential of the electrophotographic imaging member into the subsequent cycle, when the electrophotographic imaging member is repeatedly used.

Examples are set forth below and are illustrative embodiments. It will be apparent to one skilled in the art that the embodiments can be practiced with many types of compositions and can have many different uses in accordance with the disclosure above and as pointed out hereinafter.

EXAMPLES

Example 1

In Example 1, an undercoat layer was prepared as follows: a titanium oxide/phenolic resin/melamine resin dispersion was prepared by ball milling 15 grams of titanium dioxide (MT-150W, Tayca Company), 12.3 grams of the phenolic resin (VARCUM™ 29159, OxyChem Company, $M_w$, of about 3,600, viscosity of about 200 cps) and 3.3 grams of the melamine resin (CYMEL™ 323, CYTEC) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™/CYMEL™ dispersion. 0.5 grams of methyl ethyl ketone and 0.1 grams of the acid catalyst (CYCAT™ 4040, CYTEC) was added into the dispersion to obtain the coating dispersion. Then an aluminum drum, cleaned with detergent and rinsed with deionized water, was coated with the above generated coating dispersion, and subsequently, dried at 160° C. for 15 minutes, which resulted in an undercoat layer deposited on the aluminum and comprised of $TiO_2$/VARCUM™/CYMEL™ with a weight ratio of about 63/25.9/11.1 and a thickness of 17 microns.

An HOGaPc photogeneration layer dispersion was prepared as follows: 3 grams of HOGaPc Type V pigment was mixed with about 2 grams of VMCH (Dow Chemical) and 45 grams of n-butyl acetate. The mixture was milled in an Attritor mill with about 200 grams of 1 mm Hi-Bea borosilicate glass beads for about 3 hours. The dispersion was filtered through a 20-μm nylon cloth filter, and the solid content of the dispersion was diluted to about 5 weight percent with n-butyl acetate. The HOGaPc photogeneration layer dispersion was applied on top of the undercoat layer. The thickness of the photogeneration layer was approximately 0.2 μm. Subsequently, a 27 μm charge transport layer was coated on top of the photogeneration layer from a solution prepared from N,N'-diphenyl-N,N-bis(3-methylphenyl)-1,1'-biphenyl-4,4'-diamine (5 grams) and a film forming polymer binder PCZ-400 [poly(4,4'-dihydroxy-diphenyl-1-1-cyclohexane, $M_w$=40,000)] available from Mitsubishi Gas Chemical Company, Ltd. (7.5 grams) dissolved in a solvent mixture of 20 grams of tetrahydrofuran (THF) and 6.7 grams of toluene. The charge transport layer was dried at about 120° C. for about 40 minutes.

Comparative Example 1

In Comparative Example 1, a photoreceptor was formed in the same manner as for Example 1. However, in Comparative Example 1, the undercoat layer was prepared as follows: a titanium oxide/phenolic resin dispersion was prepared by ball milling 15 grams of titanium dioxide (MT-150W, Tayca Company) and 17.6 grams of the phenolic resin (VARCUM™ 29159, OxyChem Company, $M_w$ of about 3,600, viscosity of about 200 cps) in 7.5 grams of 1-butanol, and 7.5 grams of xylene with 120 grams of 1 millimeter diameter sized $ZrO_2$ beads for 5 days. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. 0.5 grams of methyl ethyl ketone was added into the dispersion to obtain the coating dispersion. Then an aluminum drum, cleaned with detergent and rinsed with deionized water, was coated with the above generated coating dispersion, and subsequently, dried at 160° C. for 15 minutes, which resulted in an undercoat layer deposited on the aluminum and comprised of $TiO_2$/VARCUM™ with a weight ratio of about 63/37 and a thickness of 17 microns. The undercoat layer in Comparative Example 1 did not include a melamine resin, and did not include the components ratio of Example 1.

The above prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters; the exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

The photoreceptors of Example 1 exhibited significantly lower B zone (50% humidity and 22° C.) and C zone (10% humidity and 15° C.) $V_r$ values as compared to the photoreceptors of Comparative Example 1. Specifically, the photoreceptor of Comparative Example 1 exhibited a B zone $V_r$ of about 96 V, while the photoreceptor of Example 1 exhibited a B zone $V_r$ of about 40 V. In addition, the photoreceptor of Comparative Example 1 exhibited a C zone $V_r$ of about 181 V, while the photoreceptor of Example 1 exhibited a C zone $V_r$ of about 15 V. The incorporation of more hydrophilic melamine resin into undercoat layer significantly boosts electron conductivity of the layer, especially in dry and cold environments.

Furthermore, the charge electric properties and the erase electric properties of the photoreceptor of Example 1 did not significantly vary from the charge electric properties and the erase electric properties of the photoreceptor of Comparative Example 1. Accordingly, the electric properties of the photoreceptor of Example 1 is not adversely affected by the presence of the undercoat layer containing metal oxide nanoparticles and a co-resin of phenolic resin and melamine resin.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims

What is claimed is:

1. An electrophotographic imaging member, comprising:

a support layer;

an undercoat layer comprising a binder which comprises metal oxide nanoparticles and a co-resin comprising a phenolic resin and an aminoplast resin;

wherein the aminoplast resin is a glycoluril-formaldehyde resin;

a charge generation layer; and a charge transport layer.

2. The electrophotographic imaging member of claim 1, wherein the phenolic resin is a phenolic-formaldehyde resin.

3. The electrophotographic imaging member of claim 1, wherein the metal oxide nanoparticles have a powder volume resistivity varying from about $10^4$ to about $10^{10}$ Ωcm at a 100 kg/$cm^2$ loading pressure, 50% humidity, and room temperature.

4. The electrophotographic imaging member of claim 1, wherein the metal oxide nanoparticles are selected from the group consisting of ZnO, $SnO_2$, $TiO_2$, $Al_2O_3$, $SiO_2$, $ZrO_2$, $In_2O_3$, $MoO_3$, and a complex oxide thereof.

5. The electrophotographic imaging member of claim 4, wherein the metal oxide nanoparticles are $TiO_2$.

6. The electrophotographic imaging member of claim 1, wherein a ratio of the metal oxide nanoparticles to the co-resin is from about 20/80 to about 80/20 wt/wt.

7. The electrophotographic imaging member of claim 1, wherein a ratio of the metal oxide nanoparticles to the co-resin is from about 40/60 to about 65/35 wt/wt.

8. The electrophotographic imaging member of claim 1, wherein a ratio of the phenolic resin to the aminoplast resin in the co-resin is from about 1/99 to about 99/1 wt/wt.

9. The electrophotographic imaging member of claim 1, wherein the binder further comprises an acid catalyst.

10. The electrophotographic imaging member of claim 9, wherein the acid catalyst is para-toluene sulfonic acid.

11. The electrophotographic imaging member of claim 1, wherein the acid catalyst is present in an amount of about 0% to about 1.0% by weight of a total weight of the binder.

12. The electrophotographic imaging member of claim 1, wherein the undercoat layer has a thickness of from about 0.1 μm to about 30 μm.

13. The electrophotographic imaging member of claim 1, wherein a ratio of the metal oxide nanoparticles to the co-resin in the undercoat layer is about 40/60 to about 70/30 wt/wt.

14. The electrophotographic imaging member of claim 1, wherein a ratio of the phenolic resin to the aminoplast resin in the co-resin of the undercoat layer is about 30/70 to about 70/30 wt/wt.

15. A process cartridge comprising the electrophotographic imaging member of claim 1 and at least one of a developing unit and a cleaning unit.

16. The process cartridge of claim 15, wherein the undercoat layer has a thickness of from about 0.1 μm to about 30 μm, the metal oxide nanoparticles have a powder volume resistivity varying from about $10^4$ to about $10^{10}$ Ωcm at a 100 kg/cm$^2$ loading pressure, 50% humidity, and room temperature.

17. An image forming apparatus comprising at least one charging unit, at least one exposing unit, at least one developing unit, a transfer unit, a cleaning unit, and the electrophotographic imaging member of claim 1.

18. The image forming apparatus of claim 17, wherein the undercoat layer has a thickness of from about 0.1 μm to about 30 μm, the metal oxide nanoparticles have a powder volume resistivity varying from about $10^4$ to about $10^{10}$ Ωcm at a 100 kg/cm$^2$ loading pressure, 50% humidity, and room temperature.

* * * * *